US005911344A

United States Patent [19]

Kieras

[11] Patent Number: 5,911,344

[45] Date of Patent: Jun. 15, 1999

[54] RIGID THERMOPLASTIC SQUEEZE CONTAINER HAVING SELF-SEALING DISPENSING VALVE

[75] Inventor: Ronald E. Kieras, Woodstock, Ill.

[73] Assignee: Courtaulds Packaging Inc., Woodstock, Ill.

[21] Appl. No.: 08/976,016

[22] Filed: Nov. 21, 1997

[51] Int. Cl.[6] ..... B67D 5/06

[52] U.S. Cl. ..... 222/183; 222/209; 222/212

[58] Field of Search ..... 222/183, 209, 222/212, 494

[56] References Cited

U.S. PATENT DOCUMENTS

| | | | |
|---|---|---|---|
| 1,109,110 | 9/1914 | Clark . | |
| 1,481,339 | 1/1924 | Barron . | |
| 1,844,215 | 2/1932 | Edwards . | |
| 2,686,616 | 8/1954 | Barlow | 222/107 |
| 3,047,910 | 8/1962 | Downs | 18/59 |
| 4,991,745 | 2/1991 | Brown | 222/212 |
| 5,033,655 | 7/1991 | Brown | 222/212 |
| 5,069,856 | 12/1991 | Holoubek et al. | 264/519 |
| 5,213,236 | 5/1993 | Brown et al. | 222/185 |
| 5,339,995 | 8/1994 | Brown et al. | 222/185 |
| 5,377,877 | 1/1995 | Brown et al. | 222/105 |
| 5,409,144 | 4/1995 | Brown | 222/185 |
| 5,439,143 | 8/1995 | Brown et al. | 222/185 |
| 5,454,486 | 10/1995 | Mack et al. | 222/95 |

FOREIGN PATENT DOCUMENTS

| | | | |
|---|---|---|---|
| WO 93/10020 | 5/1993 | WIPO | 222/209 |
| WO 93/14021 | 7/1993 | WIPO | 222/209 |

*Primary Examiner*—Philippe Derakshani
*Attorney, Agent, or Firm*—Armstrong, Westerman, Hattori, McLeland & Naughton

[57] ABSTRACT

A rigid thermoplastic squeeze container having a self-sealing dispensing valve, for use with flowable substances, has a cylindrical shell with a body portion, a first sealable open end and an opposite end having a head portion with a dispensing orifice closed off by a self-sealing valve. A thermoplastic cylindrical support sleeve is fitted within the cylindrical body portion which extends from a position adjacent the head portion to a location spaced from the sealable end of the cylindrical body portion of the shell, such that that end can be sealed. The cylindrical shell and cylindrical body portion may be bonded together, and the head portion of the cylindrical body portion of the shell may have a downwardly depending flange to trap an end of the cylindrical support sleeve between the flange and the cylindrical body portion.

17 Claims, 3 Drawing Sheets

RIGID THERMOPLASTIC SQUEEZE CONTAINER HAVING SELF-SEALING DISPENSING VALVE

FIELD OF THE INVENTION

The present invention is to a thermoplastic squeeze container for a flowable substance and more particularly to a thermoplastic squeeze container incorporating a self-sealing dispensing valve or closure.

BACKGROUND OF THE INVENTION

Thermoplastic containers are used to package and dispense numerous flowable substances, such as powders, pastes or liquids. Of special interest are squeezable containers, such as bottles or tubes formed of thermoplastic material which containers are squeezed, by application of pressure on the sidewall of the container, so as to dispense a flowable substance from an orifice in a neck formed on the container. In order to provide a thermoplastic squeeze container, the wall of the container must be formed of a thermoplastic material that will flex so as to enable forcing of the flowable substance therefrom. Generally, such thermoplastic squeeze containers, after squeezing, are retained in the shape formed when a flowable substance is dispensed, i.e. in a somewhat collapsed condition.

In certain instances, it is desirable to use a self-sealing or self-closing valve in combination with a thermoplastic squeeze container. Examples of such containers containing self-sealing valves are, for example, shown and described in U.S. Pat. No. 5,033,655 and U.S. Pat. No. 5,213,236. As described in these patents, a dispensing package may contain a self-sealing valve which securely seals upon cessation of pressure on the side wall of the container, so as to protect the contents thereof from the atmosphere, but upon squeezing of the side wall the contents will be dispensed. The use of a self-sealing valve in combination with a tube shaped container is suggested in U.S. Pat. No. 5,033,655 and illustrated generally in FIGS. 6 and 7 of that patent. In order to use such a self-sealing valve in a tubular container, however, the side wall of the tubular container must have a specific rigidity or thickness such that, while being squeezable, the side wall will return to the shape that existed before squeezing such that air will be sucked back into the container body so as to close the self-sealing valve. The formation of such thick-walled tubular containers is expensive and requires special equipment.

The formation of tubular containers from a longitudinally stretched, extruded, thermoplastic cylinder has been effected in an economical, efficient, and commercially viable method, such as described in U.S. Pat. No. 3,047,910 to Downs, and U.S. Pat. No. 5,069,856 to Holoubek & Rhoades. These methods are somewhat limited, however, in that a wall thickness of about 0.012 to 0.025 inch is about the maximum wall thickness that can be efficiently and economically achieved. Thus, such a method is generally not suited for producing thick walled tubes for use in a tubular container containing a self-sealing valve, as previously described.

It is an object of the present invention to provide a thermoplastic squeeze container containing a self-sealing dispensing valve the container having a side wall that is squeezable to dispense flowable material therefrom but having sufficient rigidity such that the side wall returns to a noncollapsed position upon release of pressure on the side wall so as to suck in and close the self-sealing valve.

SUMMARY OF THE INVENTION

A thermoplastic squeeze container for flowable substances has a cylindrical shell with a cylindrical body portion with inner and outer surfaces, a first sealable open end, and a head portion at the opposite or second end that has a dispensing orifice therethrough and a self-sealing valve closing the dispensing orifice. A cylindrical support sleeve of thermoplastic material is contained within the cylindrical body portion having an outer surface substantially contiguous with the inner surface of the cylindrical body portion, which sleeve extends from a position adjacent the head portion of the cylindrical body portion to a location adjacent the first sealable open end thereof, such that the open end can be closed and sealed without interference by the cylindrical support sleeve.

Preferably, both the cylindrical shell and the support sleeve are formed from a longitudinally stretched, extruded, thermoplastic cylinder, and the outer surface of the cylindrical support sleeve is bonded to the inner surface of the cylindrical body portion, such as by sonic welding.

In another embodiment, a downwardly extending flange is provided on a shoulder of the head portion of the cylindrical body portion which is spaced from the inner surface of the cylindrical body portion and traps or seats an end of the cylindrical support sleeve between the flange and the cylindrical body portion.

BRIEF DESCRIPTION OF THE DRAWINGS

The present invention will be more fully understood by reference to the following description and accompanying drawings illustrating a preferred embodiment thereof, wherein.

DETAILED DESCRIPTION

Figure 3:
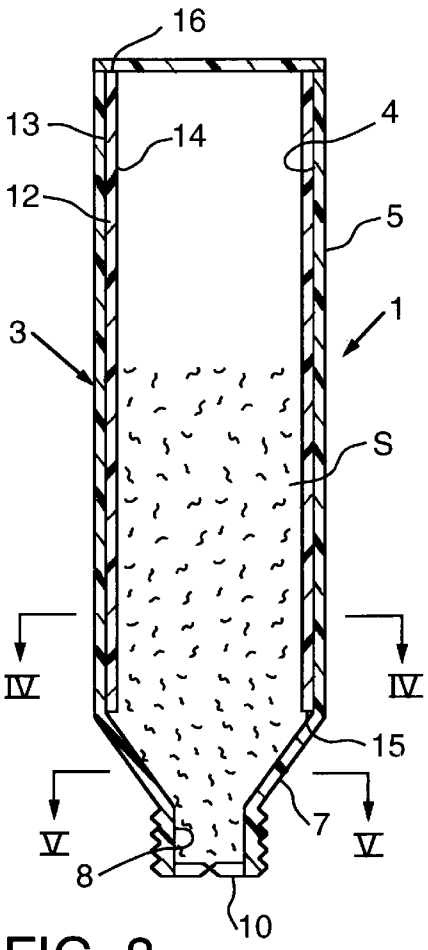
FIG. 3 is a sectional view as in FIG. 2 showing the squeeze container after a portion of the flowable substance has been dispensed therefrom.

Referring now to the drawings, one embodiment a thermoplastic squeeze container 1, for containment and dispensing of a flowable substance has a cylindrical shell 2 with a cylindrical body portion 3 that has an inner surface 4 and outer surface 5. The cylindrical body portion 3 has a first sealable open end 6 and a head portion 7 that forms a dispensing orifice 8 at the opposite or second end 9 of the cylindrical body portion 3.

A self-sealing dispensing valve 10 is provided in the head portion 7 which closes the dispensing orifice 8. A cap 11 may be provided to enclose the self-sealing dispensing valve 10 during, filling, shipping and storage of the thermoplastic squeeze tube.

Examples of the type of self-sealing dispensing valves that may be used in the thermoplastic squeeze tube of the present invention are those described in U.S. Pat. No. 4,991,745, U.S. Pat. No. 5,033,655, U.S. Pat. No. 5,213,236, U.S. Pat. No. 5,339,995, U.S. Pat. No. 5,377,877, U.S. Pat. No. 5,409,144, U.S. Pat. No. 5,439,143, the contents of all of said seven patents being incorporated by reference herein.

Figure 2:
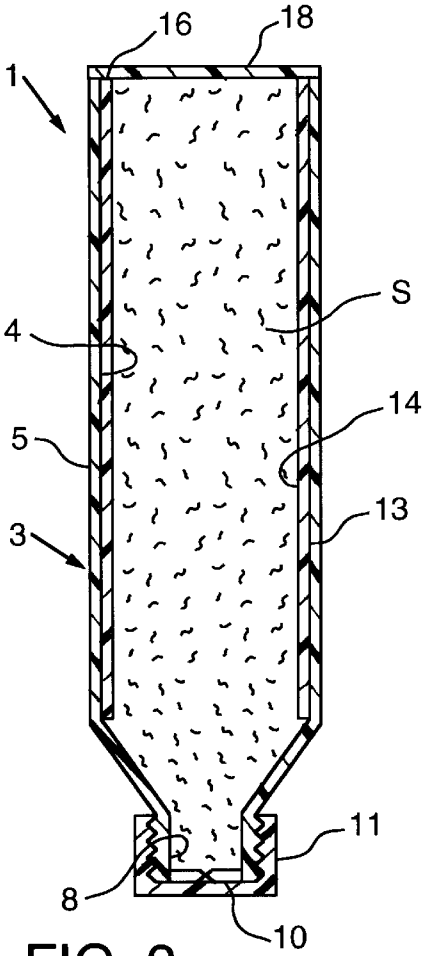
FIG. 2 is a sectional view as in FIG. 1 showing the squeeze container filled with a flowable substance and with the first open end sealed.
Figure 1:
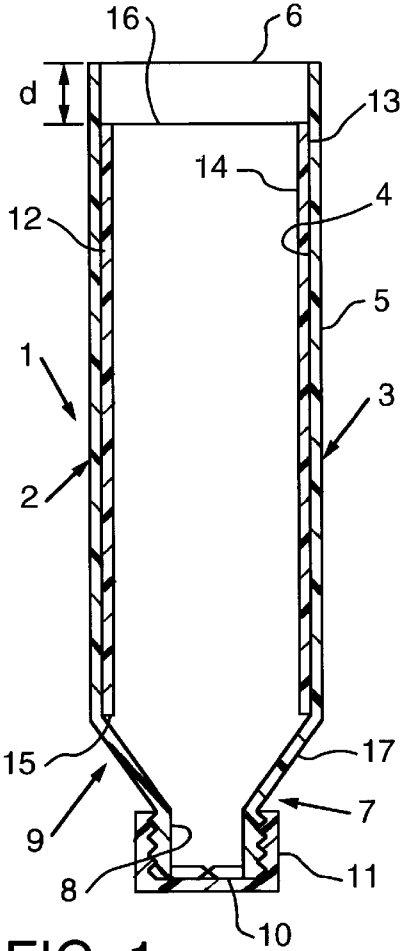
FIG. 1 is a sectional view through a rigid thermoplastic squeeze container having a self-sealing dispensing valve according to the present invention before filling with a flowable substance.
Figure 4:
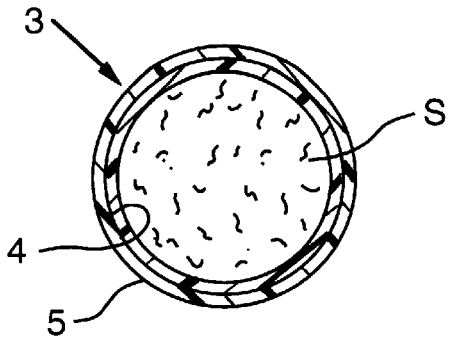
FIG. 4 is a view taken along the line IV—IV of FIG. 3.
Figure 5:
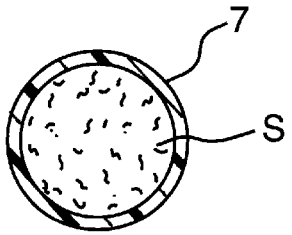
FIG. 5 is a view taken along the line V—V of FIG. 3.
Figure 6:
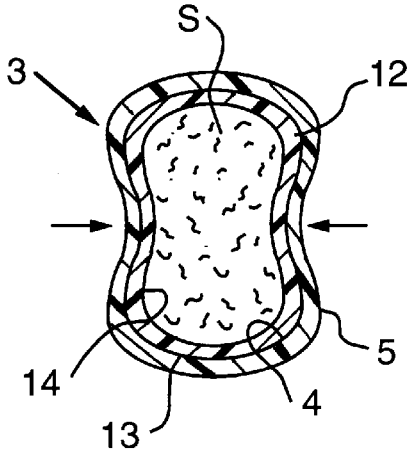
FIG. 6 is a view similar to FIG. 4 showing the container with application of pressure on the side wall of the container to dispense flowable substance therefrom.

A cylindrical support sleeve 12 of thermoplastic material having an outer surface 13, inner surface 14, first end 15, and second end 16 is contained within the cylindrical body portion 3. The outer surface 13 of the cylindrical support sleeve 12 is substantially contiguous with the inner surface 4 of the cylindrical body portion 3, and the cylindrical support sleeve 12 extends from a position adjacent the head portion 7 to a location adjacent the first sealable end 6 of the cylindrical body portion 3, but spaced therefrom a distance d such that the first sealable end 6 can be sealed by closing the same without interference by said cylindrical support sleeve 12. The first end 15 of the cylindrical support sleeve 12 is adjacent a neck portion 7 of the cylindrical body portion 3, while the second end 16 is adjacent but spaced from the sealable open end 6 of the cylindrical body portion 3 so that the open end may be sealed, as shown by a seal 18 in FIG. 2, such as by heat sealing of the open end 6, after a flowable substance S has been charged thereto.

The outer surface 13 of the cylindrical support sleeve 12 may be bonded to the inner surface 4 of the cylindrical body portion 3 by bonding techniques, such as by use of an adhesive or by sonic welding.

The thermoplastic body portion 3 and the cylindrical support sleeve 12 may be formed from the same or different thermoplastic materials, such as low density polyethylene which has a density of between about 0.910 to 0.925 g/cm$^3$, as identified by ASTM standards, or a high density polyethylene which has a density of between about 0.941 to 0.959 g/cm$^3$. In addition to polyethylene, other thermoplastic materials may be used, such as polypropylene, polyvinyl chloride, and the like.

The cylindrical shell 2 from which the cylindrical body portion 3 is made, and also the cylindrical support sleeve 12 are both preferably formed from a longitudinally stretched, extruded, thermoplastic tube, and may be a single layer or a multi-layer or laminate material. Such extrusion and stretching techniques are known, for example, as described in U.S. Pat. No. 5,069,856 which is assigned to the assignee of the present invention, the contents of said patent incorporated by reference herein.

As an example of the type of thermoplastic squeeze container of the present invention, a cylindrical body portion 3 would preferably have a wall thickness of between about 0.015 to 0.021 inch and an interior diameter of slightly larger than about 2 inches, in which a cylindrical support sleeve of an outer diameter of about 2 inches and a wall thickness of between about 0.015 to 0.027 is provided. The first end 15 of the cylindrical support sleeve 12 would extend from a portion adjacent the neck portion 7 to a distance where the second end 16 is spaced from the open end 6 of the cylindrical body portion 3 of about 0.25 inch or more which will enable sealing of the open end 6 without interference by the cylindrical support sleeve 12.

Figure 7:
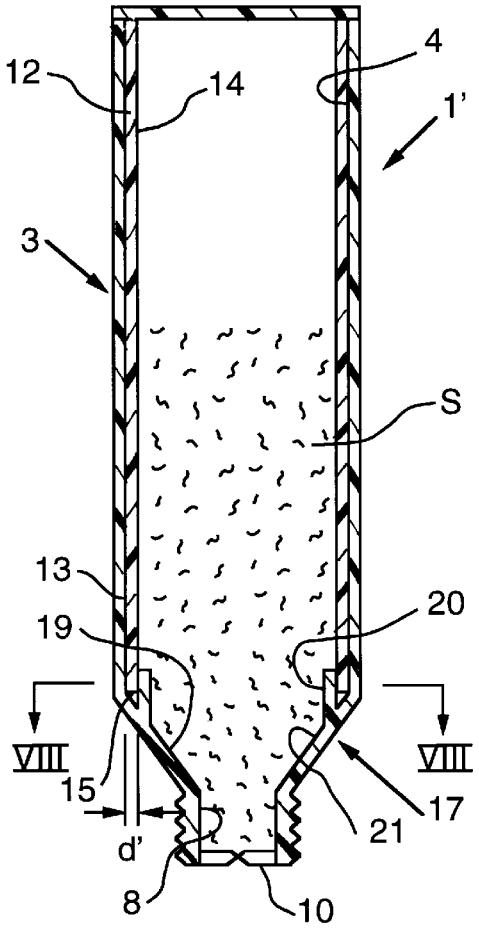
FIG. 7 is a sectional view through a rigid thermoplastic squeeze container having a self-sealing dispensing valve according to another embodiment of the present invention.
Figure 8:
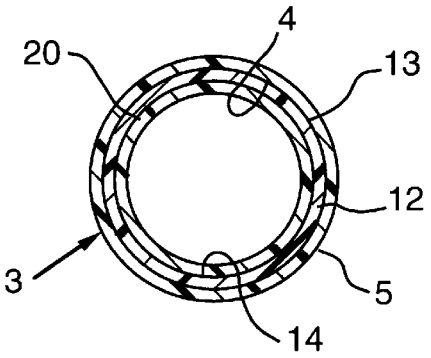
FIG. 8 is a view taken along lines VIII—VIII of FIG. 7 showing a downwardly depending flange.
Figure 9:
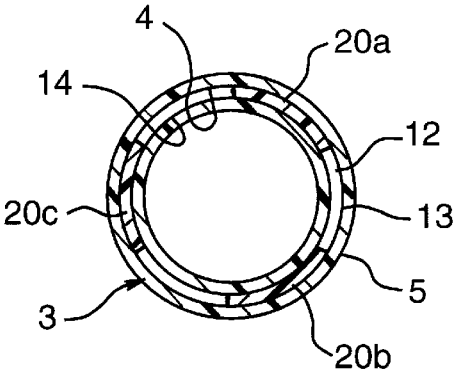
FIG. 9 is a view similar to FIG. 8 showing the use of a plurality of flange sections.

Another embodiment of the thermoplastic squeeze container of the present invention is illustrated in FIG. 7, where the structure is adapted to trap the first end 15 of the cylindrical body portion. As illustrated, the thermoplastic squeeze container 1' has a cylindrical shell 2 with a cylindrical body portion 3 having an inner surface 4 and outer surface 5. A first sealable open end 6 is provided, as is a head portion 7 forming a dispensing orifice 8 at the opposite end of the cylindrical body portion 3. A self-sealing dispensing valve 10 is provided in the head portion which closes the dispensing orifice 8. As in the first embodiment described, a cylindrical support sleeve 12 of thermoplastic material has an outer surface 13, an inner surface 14, a first end 15 and second end 16, which cylindrical support sleeve is contained within the cylindrical body portion 3. The outer surface 13 of the cylindrical support sleeve 12 is contiguous with the inner surface 4 of the cylindrical body portion 3 and extends from a position adjacent the head portion 7 to a location adjacent the first sealable end 6 of the cylindrical body portion 3, but spaced therefrom a distance d from sealing of the first sealable end 6. In the embodiment of FIG. 7, the head portion has a neck portion 7 which has a shoulder 19 connecting the neck portion 7 with the cylindrical body portion 3. A downwardly depending flange 20 is provided on the inner surface 21 of the shoulder 19 which is spaced from the inner surface 4 of the cylindrical body portion 3 a distance d' that is sized so as to trap the first end 15 of the cylindrical support sleeve 12 between the downwardly depending flange 20 and the cylindrical body portion 3. The flange may be a continuous flange (FIG. 8) or in the form of at least one flange section (FIG. 9) extending partially about the inner circumference of said cylindrical sleeve, such as flange sections 20*a*, 20*b* and 20*c* illustrated in FIG. 9.

With the use of a cylindrical shell and a cylindrical support sleeve to produce the squeeze containers of the present invention, conventional filling and sealing equipment can be used as the same acts in the manner of a container or tube of conventional design but having a thicker wall. The self-sealing dispensing valve may be a single layer of material or may be a composite material such as one having barrier properties.

The thermoplastic squeeze container of the present invention provides excellent protection for the contents of the container from the environment, while enabling squeezing of the cylindrical body portion to dispense a desired amount of contents therefrom, with the combined rigidity of the cylindrical body portion and cylindrical support sleeve returning to rest or unsqueezed position to ensure suck-back and closure of the self-sealing valve.

What is claimed is:

1. A thermoplastic squeeze container for containment and dispensing of a flowable substance comprising:

a cylindrical shell having a cylindrical body portion with an inner surface and an outer surface, a first sealable open end and an opposed end having a head portion forming a dispensing orifice;

a self-sealing dispensing valve in said head portion closing said dispensing orifice, and;

a cylindrical support sleeve of thermoplastic material having an outer surface, contained within said cylindrical body portion, the outer surface of which is contiguous with said inner surface of said cylindrical body portion and extends from a position adjacent said head portion to a location adjacent to the first sealable end of said cylindrical body portion such that said end can be sealed by closing said cylindrical body portion without interference by said cylindrical support sleeve.

2. The thermoplastic squeeze container as defined in claim 1 wherein said cylindrical shell is formed from a longitudinally stretched, extruded, thermoplastic cylinder.

3. The thermoplastic squeeze container as defined in claim 2 wherein said cylindrical support sleeve is formed from a longitudinally stretched, extruded, thermoplastic cylinder.

4. The thermoplastic squeeze container as defined in claim 1 wherein said cylindrical support sleeve and said cylindrical body portion are bonded together.

5. The thermoplastic squeeze container as defined in claim 4 wherein said bonding is by sonic welding.

6. The thermoplastic squeeze container as defined in claim 1 including a shoulder on said head portion having an inner surface and a downwardly depending flange on the inner surface of said shoulder, spaced from the inner surface of said cylindrical body portion and sized so as to trap an end of said cylindrical support sleeve between the downwardly depending flange and the cylindrical body portion.

7. The thermoplastic squeeze container as defined in claim 6 wherein said downwardly depending flange is a continuous flange.

8. The thermoplastic squeeze container as defined in claim 6 wherein said downwardly depending flange is formed of at least one flange section extending partially about the inner circumference of said cylindrical sleeve.

9. A thermoplastic squeeze container for containment and dispensing of a flowable substance comprising:

a cylindrical shell, formed from a longitudinally stretched, extruded, thermoplastic cylinder, having a cylindrical body portion with an inner surface and an outer surface, a first sealable open end an opposed end having a head portion forming a dispensing orifice;

a self-sealing dispensing valve in said head portion closing said dispensing orifice, and;

a cylindrical support sleeve of thermoplastic material, formed from a longitudinally stretched, extruded, thermoplastic cylinder, having an outer surface, contained within said cylindrical body portion, the outer surface of which is contiguous with said inner surface of said cylindrical body portion and extends from a position adjacent said head portion to a location adjacent to the first sealable end of said cylindrical body portion such that said end can be sealed by closing said cylindrical body portion without interference by said cylindrical support sleeve.

10. The thermoplastic squeeze container as defined in claim 9 wherein said cylindrical support sleeve and said cylindrical body portion are bonded together.

11. The thermoplastic squeeze container as defined in claim 9 wherein said bonding is by sonic welding.

12. The thermoplastic squeeze container as defined in claim 9 including a shoulder on said head portion having an inner surface and a downwardly depending flange on the inner surface of said shoulder, spaced from the inner surface of said cylindrical body portion and sized so as to trap an end of said cylindrical support sleeve between the downwardly depending flange and the cylindrical body portion.

13. A thermoplastic squeeze container for containment and dispensing of a flowable substance comprising:

a cylindrical shell, formed from a longitudinally stretched, extruded, thermoplastic cylinder, having a cylindrical body portion with an inner surface and an outer surface, a first sealable open end and an opposed end having a head portion forming a dispensing orifice, said head portion including a shoulder having an inner surface;

a self-sealing dispensing valve in said head portion closing said dispensing orifice;

a downwardly depending flange on the inner surface of said shoulder, spaced from the inner surface of said cylindrical body portion and sized so as to trap an end of a cylindrical support sleeve between the downwardly depending flange and the cylindrical body portion; and a cylindrical support sleeve of thermoplastic material, formed from a longitudinally stretched, extruded, thermoplastic cylinder, having an outer surface, contained within said cylindrical body portion, the outer surface of which is contiguous with said inner surface of said cylindrical body portion and extends from a position adjacent said head portion to a location adjacent to the first sealable end of said cylindrical body portion such that said end can be sealed by closing said cylindrical body portion without interference by said cylindrical support sleeve, with an end of said cylindrical support sleeve trapped between the flange of said shoulder and said cylindrical body portion.

14. The thermoplastic squeeze container as defined in claim 13 wherein the outer surface of said cylindrical support sleeve is bonded with said cylindrical body portion.

15. The thermoplastic squeeze container as defined in claim 14 wherein said bonding is by sonic welding.

16. The thermoplastic squeeze container as defined in claim 13 wherein said downwardly depending flange is a continuous flange.

17. The thermoplastic squeeze container as defined in claim 13 wherein said downwardly depending flange is formed of at least one flange section extending partially about the inner circumference of said cylindrical sleeve.

* * * * *